US010820722B2

(12) United States Patent
Pierson et al.

(10) Patent No.: US 10,820,722 B2
(45) Date of Patent: Nov. 3, 2020

(54) NO TOUCH UTENSIL DISPENSER

(71) Applicant: Waddington North America, Inc., Chelmsford, MA (US)

(72) Inventors: Mark V. Pierson, Binghamton, NY (US); Anthony D'Amelia, Binghamton, NY (US)

(73) Assignee: Waddington North America, Inc., Chelmsford, MA (US)

( * ) Notice: Subject to any disclaimer, the term of this patent is extended or adjusted under 35 U.S.C. 154(b) by 15 days.

(21) Appl. No.: 16/182,185

(22) Filed: Nov. 6, 2018

(65) Prior Publication Data

US 2019/0075940 A1 Mar. 14, 2019

Related U.S. Application Data

(63) Continuation of application No. 13/161,767, filed on Jun. 16, 2011, which is a continuation-in-part of application No. 12/831,396, filed on Jul. 7, 2010, now Pat. No. 8,272,533.

(51) Int. Cl.

| | |
|---|---|
| ***A41F 1/08*** | (2006.01) |
| ***A47F 1/08*** | (2006.01) |
| ***A47F 1/10*** | (2006.01) |

(52) U.S. Cl.

CPC ..... *A47F 1/08* (2013.01); *A47F 1/10* (2013.01); *A47F 2001/103* (2013.01)

(58) Field of Classification Search

CPC ..... A47F 1/08; A47F 1/10; A47F 2001/103
USPC ..... 221/309, 22, 27, 28, 29, 172, 178, 191, 221/194, 195, 247, 250, 255
See application file for complete search history.

(56) References Cited

U.S. PATENT DOCUMENTS

| | | | |
|---|---|---|---|
| 512,162 | A | 1/1894 | Cuddy |
| 2,141,684 | A | 12/1938 | Diemer |
| 2,149,099 | A | 2/1939 | Phinney et al. |
| 2,216,005 | A | 9/1940 | Goldstein |
| 2,752,678 | A | 7/1956 | Welch |
| 2,911,127 | A | 11/1959 | Dress et al. |
| 3,987,901 | A | 10/1976 | Dullinger |
| 4,134,519 | A | 1/1979 | Barnett et al. |
| D275,167 | S | 8/1984 | Laslo |
| 4,524,512 | A | 6/1985 | Formo |
| 4,539,749 | A | 9/1985 | Hyeing-Woon |
| 4,610,087 | A | 9/1986 | Mickelson et al. |
| 4,995,154 | A | 2/1991 | Bamber |
| 5,131,562 | A | 7/1992 | Brown |
| 5,295,592 | A | 3/1994 | Thorne |
| 5,855,422 | A | 1/1999 | Naef |

(Continued)

OTHER PUBLICATIONS

Office Action dated May 18, 2020 for European Appl. No. 17779770.1, 3 pages.

(Continued)

*Primary Examiner* — Patrick H Mackey
(74) *Attorney, Agent, or Firm* — Maine Cernota & Rardin

(57) ABSTRACT

A device for dispensing cutlery utensils individually, having a housing containing a quantity of utensils with the housing having sides and product guides within. The front wall contains an opposing leaf escapement mechanism connected to it, to hold and singulate the utensils such that they dispense seriatim, without a user being required to physically touch or interface with any part of dispenser other than the actual desired utensil.

25 Claims, 10 Drawing Sheets

(56) References Cited

U.S. PATENT DOCUMENTS

| | | | | |
|---|---|---|---|---|
| 5,904,250 | A | 5/1999 | De Schutter | |
| 5,921,408 | A | 7/1999 | Gronewold et al. | |
| 6,250,498 | B1 * | 6/2001 | Lovejoy | A47F 1/04 221/185 |
| 6,336,568 | B1 | 1/2002 | Tucker et al. | |
| 6,832,694 | B2 | 12/2004 | Goeking et al. | |
| 7,013,568 | B2 | 3/2006 | Schmidt | |
| D584,084 | S | 1/2009 | Tucker et al. | |
| 7,669,732 | B2 | 3/2010 | Njaastad | |
| 7,900,797 | B1 | 3/2011 | Witcraft | |
| 8,272,533 | B1 | 9/2012 | D'Amelia et al. | |
| 8,296,957 | B2 | 10/2012 | Muehlemann | |
| 8,297,473 | B2 | 10/2012 | Smith | |
| 8,839,522 | B2 | 9/2014 | Walters | |
| 9,049,948 | B2 * | 6/2015 | Jongen | A63F 13/79 |
| 9,226,598 | B1 | 1/2016 | Knope et al. | |
| 9,924,816 | B2 | 3/2018 | Oakes | |
| 10,390,631 | B2 | 8/2019 | Smith | |
| 2005/0155229 | A1 | 7/2005 | Lee | |
| 2007/0000136 | A1 | 1/2007 | Allen et al. | |
| 2007/0108141 | A1 | 5/2007 | Smith et al. | |
| 2010/0170915 | A1 | 7/2010 | Reinsel et al. | |
| 2011/0138632 | A1 | 6/2011 | Wong | |
| 2011/0219631 | A1 | 9/2011 | Hou | |
| 2015/0048108 | A1 | 2/2015 | Borke | |
| 2015/0257561 | A1 | 9/2015 | Miksovsky | |
| 2019/0075940 | A1 | 3/2019 | Pierson | |

OTHER PUBLICATIONS

International Search Report and Written Opinion for PCT Appl. No. PCT/US2020/025001, dated Jul. 14, 2020, 12 Pages.

Office Action for U.S. Appl. No. 16/091,835, dated Aug. 3, 2020, 27 Pages.

* cited by examiner

NO TOUCH UTENSIL DISPENSER

RELATED APPLICATIONS

This application is a continuation of U.S. application Ser. No. 13/161,767, filed on Jun. 16, 2011. Application Ser. No. 13/161,767 is a continuation in part of U.S. application Ser. No. 12/831,396, filed Jul. 7, 2010, now U.S. Pat. No. 8,272,533. Both of these applications are herein incorporated by reference in their entirety for all purposes.

FIELD OF THE INVENTION

The invention pertains to a system and method of dispensing recyclable cutlery utensils and, more particularly, to a system and method that dispenses these utensils hygienically without users having to physically touch any part of a dispenser, other than the specific utensil they wish to dispense for their use.

BACKGROUND OF THE INVENTION

A convergence of factors, such as reduced antibiotic effectiveness coupled with an increasingly fast food directed environment, have combined to create a need for a new cutlery dispenser. The dispenser should have both the ability to dispense cutlery in a hygienic manner and also provides an inventory control means in that it allots only one utensil per actuation.

Disposable cutlery such plastic spoons, forks, knives, and Sporks® are normally used in casual restaurant settings and are provided by the eating establishment for use in the restaurant and with take-out food. To ensure that this cutlery is provided in a hygienic form, a purveyor often purchases bulk quantities of individual portions of cutlery each presealed in a small bag. The bag may also contain a napkin, dry condiments, and a hand sanitizer wipe. Such bags are generally more expensive than the sum of individual utensils due to the processing and materials necessary to form the bags. Also, these bags may provide more items than the user requires, which is uneconomical.

An option to such prepackaged bags is the presentation of cutlery in a tray or cup positioned near the point of sale. This approach allows the customer to select only the utensils desired. However, this form of supply can be unsanitary and unhygienic if a customer does not take a utensil that is purposely touched or inadvertently brushed against while rummaging through the proffered selection to find the perfect spoon for soup, for example. Airborne pathogens may settle on exposed surfaces of the remaining cutlery. The unregulated dispensing of the cutlery also permits the customer to take more utensils than needed, thus resulting in a lower profit margin for the establishment.

It is an object of the present invention to provide a reliable, efficient system for fulfilling recyclable cutlery needs.

It is a further object of the present invention to provide a non-electric automatic cutlery fulfillment system that requires no power budget overhead and requires little involvement or oversight by the eating establishment.

It is another object of the present invention to broaden the scope of hygienic practices and ultimately provide a secure cutlery dispensing fulfillment system.

It is still another object of the present invention to provide a time limited inventory containment process to minimize undo cutlery dispensing for personal gain.

It is a further object of the invention to provide an improved method for dispensing cutlery in a controlled fashion.

It is further still another object of the present invention to provide stackable magazine sections to enlarge the capacity of the dispenser.

DISCUSSION OF RELATED ART

U.S. Pat. No. 4,134,519 for DISPENSER FOR ELONGATE THIN FLEXIBLE ARTICLES, by Barnett, et al, granted Jan. 16, 1979 discloses a dispenser for elongated thin flexible articles stacked within a cartridge package. The unit is made of a cartridge holder vertically positioned and having a front access door and interior projections whereby a cartridge may be placed in the holder with the door open and maintained in a predetermined vertical position within the holder after the door is closed. The cartridge is provided with an opening at its lower end. The holder is provided with an opening at its lower end shaped to prevent the removal of an article unless it is gripped and flexed to conform to the opening. For this purpose, the lowermost article within the holder is held in an inclined position with one end on a step projection at the bottom of the holder. An intermediate portion of the lowermost article engaging a holder projection into the lower holder opening which is disengaged when the lowermost article is gripped and flexed in a manner to conform to the shape of the holder opening to permit removal of the lowermost article only. Window openings in both the door and cartridge allow the remaining supply of articles to be viewed at the lower end of the cartridge within the holder.

U.S. Pat. No. 6,336,568 for CUTLERY UTENSIL DISPENSER, by Tucker, et al, granted Jan. 8, 2002 discloses apparatus for dispensing cutlery utensils one at a time upon hand operation of an externally accessible utensil delivery controller. The dispenser includes a housing having at least one interior compartment in communication with an exit opening. At least partially accommodable within the interior compartment is a stack of utensils within a cartridge capable of universally accommodating knives or forks or spoons and provided with a portal through which a single utensil can pass and wherein a dispensable utensil is situated. The portal is situated in a pathway aligned with the exit opening. The utensil delivery controller is an externally accessible hand operable ejector engageable with the dispensable utensil for ejecting the dispensable utensil from the portal of the cartridge and thereafter through the pathway to the exit opening for ultimate user retrieval.

U.S. Pat. No. 6,832,694 for DISPENSER FOR CUTLERY UTENSILS, by Goeking, et al, granted Dec. 21, 2004 discloses a utensil dispenser for dispensing a utensil. The dispenser includes a base, which defines at least one dispensing opening. At least one utensil is positioned on or adjacent to a top surface of the base. The dispenser includes a dispensing mechanism capable of moving the one utensil. The utensil is dispensed by the dispensing mechanism moving the utensil to fall through the dispensing opening.

United States Published Patent Application No. 2007/0108141 for DISPENSER FOR DISPOSABLE CUTLERY AND COMPONENTS THEREFOR, by Smith, et al, published May 17, 2007 describes a dispenser for disposable cutlery and also relates to banded packets of disposable cutlery that can be used in the dispenser, as well as other cutlery dispensers that do not use a cartridge therein.

U.S. Design Pat. No. D584,084 for REFILLABLE CUTLERY DISPENSER MAGAZINE, by Tucker, granted Jan. 6, 2009 discloses an ornamental design for a refillable cutlery dispenser magazine.

The previously outlined United States issued patents and published applications 20 fail to adequately describe or disclose the present invention.

SUMMARY OF THE INVENTION

The present invention is directed to an automated mechanical system and method for performing cutlery fulfillment for an organization that wishes to replace unhygienic cutlery dispensing. A preferred embodiment of the present invention includes an escapement mechanism that is manually activated as a customer removes a utensil from a dispenser and a replacement utensil is gravitationally compelled to seek its lowest point at the outlet of the dispenser, and subsequently replace a dispensed article, ready for activation by the next customer.

One general aspect of the present invention is a dispenser device for dispensing utensils seriatim. The device includes a housing configured for holding a plurality of cutlery articles, said housing comprising a rear wall and a front wall oppositely disposed thereto, at least one alignment guide configured to maintain said plurality of cutlery articles in a stack within said housing, said plurality of cutlery articles being co-aligned in the stack to provide a plurality of handle ends proximate said front wall, and a plurality of distal ends proximate said rear wall, a dispensing position proximate an exit area of said dispenser device, said dispensing position being configured to maintain a handle portion of a first cutlery article at least partially accessible to a user, and an actuator mechanism configured for being activated as said user grasps said handle portion of said first cutlery article in said dispensing position and removes said first cutlery article from said dispenser device, said actuator mechanism being configured to operate mechanically when activated by said user to release a replacement cutlery article from said stack of said plurality of cutlery articles, and to deliver the replacement cutlery article to said dispensing position, said replacement cutlery article being removable by a next user upon grasping a handle portion thereof.

In embodiments, the dispenser device is compatible for dispensing a fork, a spoon, a spork, and/or a knife. In some of these embodiments where the dispenser is compatible for dispensing a knife, the device is configured to rotate said knife from a horizontal orientation to a vertical orientation as it is delivered to the dispensing position.

In various embodiments the actuator mechanism is pivotably connected to said front wall.

Embodiments further include a ledge extending inwardly from said rear wall and configured to support said stack of said plurality of cutlery articles.

Some embodiments further include a release protrusion configured to support said plurality of cutlery articles.

Various embodiments further include a release protrusion extending inwardly from an opening in said front wall and configured to support said stack of said plurality of cutlery articles, said release protrusion being retracted when said actuator mechanism is activated, and a hold protrusion disposed above said release protrusion, said hold protrusion being retracted when said release protrusion is extended, said hold protrusion being extended inwardly from said opening in said front wall when said actuator mechanism is activated and said release protrusion is retracted, said hold protrusion being configured, when extended inwardly from said opening in said front wall, to retain a remaining plurality of cutlery articles in said stack as said replacement cutlery article is released from said stack of said plurality of cutlery articles.

Certain embodiments further include a ledge extending inwardly from said rear wall and configured to support said plurality of distal ends of said cutlery articles in said stack of said plurality of cutlery articles, said actuator mechanism comprising a release protrusion and a hold protrusion, said release protrusion extending inwardly from said front wall and being configured to support said plurality of handle ends in said stack, said release protrusion being mechanically retracted by said actuator mechanism when said actuator mechanism is activated, said hold protrusion being mechanically extended inwardly when said actuator mechanism is activated so as to provide retention of a remaining plurality of cutlery articles in said stack of said plurality of cutlery articles.

In embodiments, said first cutlery article when in said dispensing position is oriented along an incline with said handle portion of said first cutlery article being lower than a distal portion of said first cutlery article.

Various embodiments further include an inclined slide groove configured to guide the handle portion of said replacement cutlery article as it is delivered to the dispensing position.

In some embodiments, upon release of the replacement cutlery article, the actuator mechanism is configured to cause the replacement cutlery article to be delivered to the dispensing position by gravitational force.

A second general aspect of the present invention is a cutlery dispenser device that includes a housing configured for holding a plurality of cutlery articles, said housing comprising a rear wall and a front wall oppositely disposed thereto, at least one alignment guide configured to maintain said plurality of cutlery articles in a stack within said housing, whereby said plurality of cutlery articles are co-aligned in the stack to provide a plurality of handle ends proximate said front wall, and a plurality of distal ends proximate said rear wall, a dispensing position configured to maintain a first cutlery article proximate an exit area of said dispenser device, such that a handle portion of said first cutlery article is at least partially accessible to a user, and an actuator mechanism configured for being activated as said user grasps said handle portion of said first cutlery article in said dispensing position and removes said first cutlery article from said dispenser device, said actuator mechanism being configured to operate mechanically when activated by said user to release a replacement cutlery article from said stack of said plurality of cutlery articles, and to deliver the replacement cutlery article to said dispensing position, said replacement cutlery article being removable by a next user upon grasping a handle portion thereof.

In embodiment, the cutlery dispenser device is compatible for dispensing at least one of a fork, a spoon, a spork, and a knife.

In various embodiments, the cutlery dispenser device is configured to rotate the first cutlery article from a horizontal orientation to a vertical orientation as it is delivered to the dispensing position.

In some embodiments, the actuator mechanism is pivotably connected to said front wall.

Certain embodiments further include a ledge extending inwardly from said rear wall and configured to support said stack of said plurality of cutlery articles.

Various embodiments further include a release protrusion configured to support said plurality of cutlery articles.

Embodiments further include a release protrusion extending inwardly from an opening in said front wall and configured to support said stack of said plurality of cutlery articles, said release protrusion being retracted when said actuator mechanism is activated, and a hold protrusion disposed above said release protrusion, said hold protrusion being retracted when said release protrusion is extended, said hold protrusion being extended inwardly from said opening in said front wall when said actuator mechanism is activated and said release protrusion is retracted, said hold protrusion being configured, when extended inwardly from said opening in said front wall, to retain a remaining plurality of cutlery articles in said stack as said replacement cutlery article is released from said stack of said plurality of cutlery articles.

Various embodiments further include a ledge extending inwardly from said rear wall and configured to support said plurality of distal ends of said cutlery articles in said stack of said plurality of cutlery articles, said actuator mechanism comprising a release protrusion and a hold protrusion, said release protrusion extending inwardly from said front wall and being configured to support said plurality of handle ends in said stack, said release protrusion being mechanically retracted by said actuator mechanism when said actuator mechanism is activated, said hold protrusion being mechanically extended inwardly when said actuator mechanism is activated so as to provide retention of a remaining plurality of cutlery articles in said stack of said plurality of cutlery articles.

In some embodiments, the dispensing position is configured to maintain said first cutlery article, when in said dispensing position, oriented along an incline with said handle portion of said first cutlery article being lower than a distal portion of said first cutlery article.

Certain embodiments further include an inclined slide groove configured to guide the handle portion of said replacement cutlery article as it is delivered to the dispensing position.

And in various embodiments, upon release of the replacement cutlery article, the actuator mechanism is configured to cause the replacement cutlery article to be delivered to the dispensing position by gravitational force.

The features and advantages described herein are not all-inclusive and, in particular, many additional features and advantages will be apparent to one of ordinary skill in the art in view of the drawings, specification, and claims. Moreover, it should be noted that the language used in the specification has been principally selected for readability and instructional purposes, and not to limit the scope of the inventive subject matter.

BRIEF DESCRIPTION OF THE DRAWINGS

A complete understanding of the present invention may be obtained by reference to the accompanying drawings, when considered in conjunction with the subsequent, detailed description, in which.

DETAILED DESCRIPTION OF THE PREFERRED EMBODIMENT

The present invention relates to a system for dispensing various cutlery objects with a no-touch approach and a method of dispensing recyclable cutlery utensils. The system dispenses these utensils without users having to physically touch any part of a dispenser, other than the specific utensil they wish to dispense for use.

For a better understanding of the present invention, together with other and further objects, advantages and capabilities thereof, reference is made to the following disclosure and appended claims.

By the term "cutlery" or "utensil" as used herein is meant a recyclable polymeric or metallic product including one or more embodiments, such as a spoon, fork, knife, Spork, and other accoutrements of dining on a budget.

By the term "no touch" and "dispenser" as used herein is meant a device that distributes cutlery or utensils without the need for a person to touch anything other than the individual cutlery itself, and can be done with one hand and a minimum of effort or motion.

Figure 1:
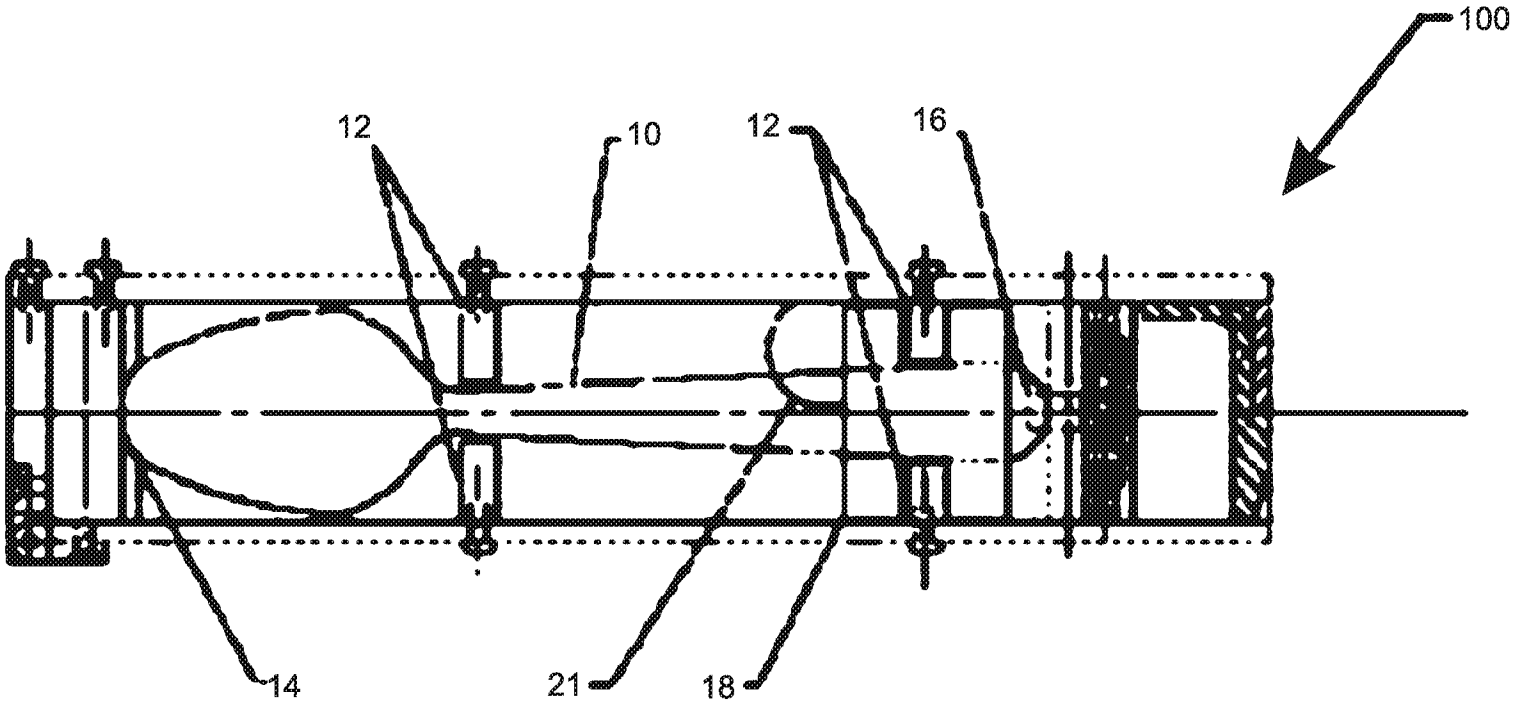
FIG. 1 is a top view of the no touch dispenser in accordance with the present invention.

Referring now to FIG. 1, there is shown a top view of a no touch dispenser 100 showing, in this embodiment, a spoon 10. Other cutlery items, such as forks, have similar boundary characteristics and subsequently are amenable to placement within the described invention with a minimum of alteration. In the described embodiment, the spoon 10 is constrained and aligned within guides 12 to ensure proper alignment and registration of the cutlery 10 to facilitate the proper sequencing and presentation of the individual cutlery items 10. At both ends of the spoon 10 are disposed respective stops, designated as distal stop 14 and escapement release protrusion 16. Escapement release protrusion 16 is described in more detail herein below with respect to subsequent figures. Weight 18 enhances the ability of non-stackable cutlery to be retained and dispensed in an orderly fashion while not jamming dispenser with misguided utensils. Retention lead 21 allows weight 18 to descend inside the no touch dispenser 100 until such time as the cutlery 10 stock is depleted. At that time, retention lead 21 restrains the weight 18 from further descent into the exit area rest position 19 (FIG. 2.)

Figure 2:
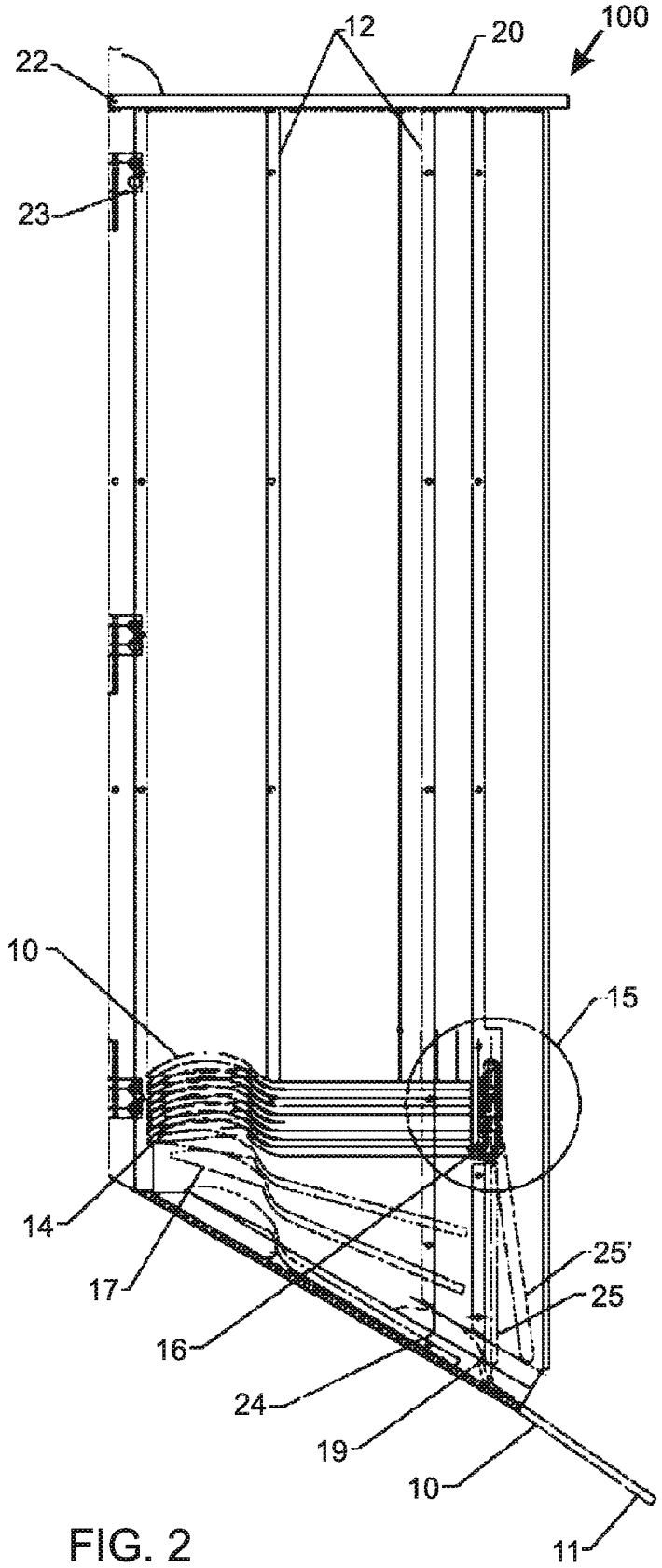
FIG. 2 is a side view of the no touch dispenser.

Referring to FIG. 2, there is shown a side view of no touch dispenser 100 with a top cover 20 attached to the body of the dispenser 100 via a hinge 22 to allow the refilling of cutlery 10 without having to remove the dispenser 100 from its support structure, not shown. Such support structure may include a planar surface of a restaurant or a rotating collection of various cutlery dispensers that allow for the selection of eating supplies. Hinge 23 allows an operator to open a side of dispenser 100 to clear any utensils 10 from the interior of the unit 100. A second embodiment of the current invention utilizes stackable magazine sections, not shown, that would allow the proprietor of the eating establishment to increase the cutlery capacity of the dispenser 100 by adding additional height to the dispenser. The stackable magazine section would have similar internal guide 12 structures to facilitate alignment and assembly ease of use.

This figure also shows a more detailed view of alignment guides 12 that work collectively to keep the cutlery 10 in a proper array for dispensing. When an item 10 is desired from the dispenser 100, a user, not shown, grasps item 10 in a location near the proximal end 11 and removes the item in a linear motion along the major axis of the cutlery 10 from exit area rest position 19.

Continuing with FIG. 2, the movement of cutlery 10 causes an escapement actuator finger 26 to move from a rest position 25 to an extended position 25', thereby retracting escapement release protrusion 16 from its position opposite distal stop 14 and releasing the next replacement utensil 10 that is gravitationally compelled to seek a point of lowest energy. This release action exposes proximal end 11 of the next utensil 10 to the outside environment of the eatery for the next customer. The dotted lines denote the motion of the utensil 10 after the retracting of escapement release protrusion 16 causes a momentary cantilever action 17. Distal stop 14 constrains the motion of the utensil 10 until the falling center of gravity pulls the utensil 10 from the distal stop 14. Utensil 10 is guided to the exit area rest position 19 by flexible wires 24. The flexible wires 24 also support and guide the utensil 10 when the exiting utensil 10 is not removed quick enough from dispenser 100 to allow the next utensil 10 to fill the exit area rest position 19 space.

Figure 3:
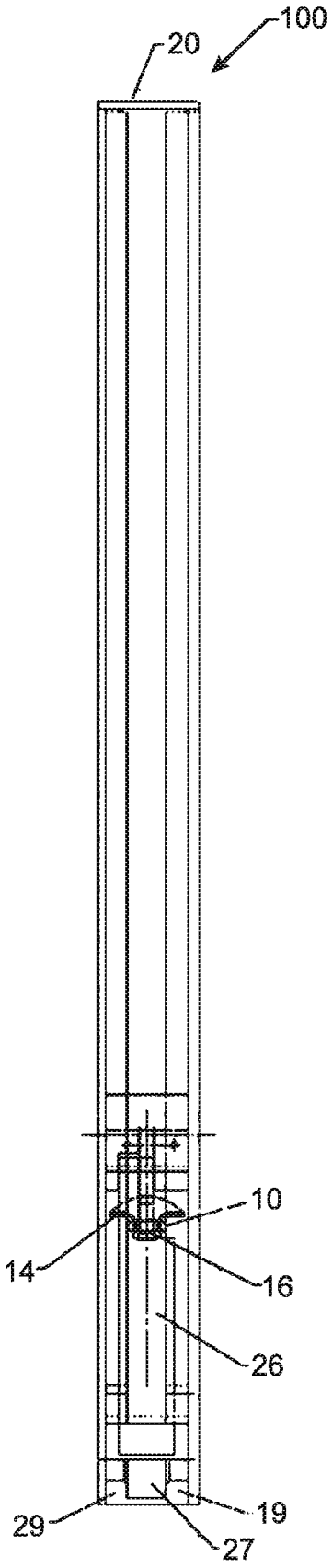
FIG. 3 is an end view of the no touch dispenser.

FIG. 3 shows a front view of dispenser 100 much as a customer would see it, albeit without a utensil 10 (FIG. 2) in the exit area rest position 19. Also shown is groove 27 in the bottom slide guide 29 that handle 10 of the falling bottom utensil drops into and slides downward until the utensil 10 stops on escapement finger 26

Figure 4:
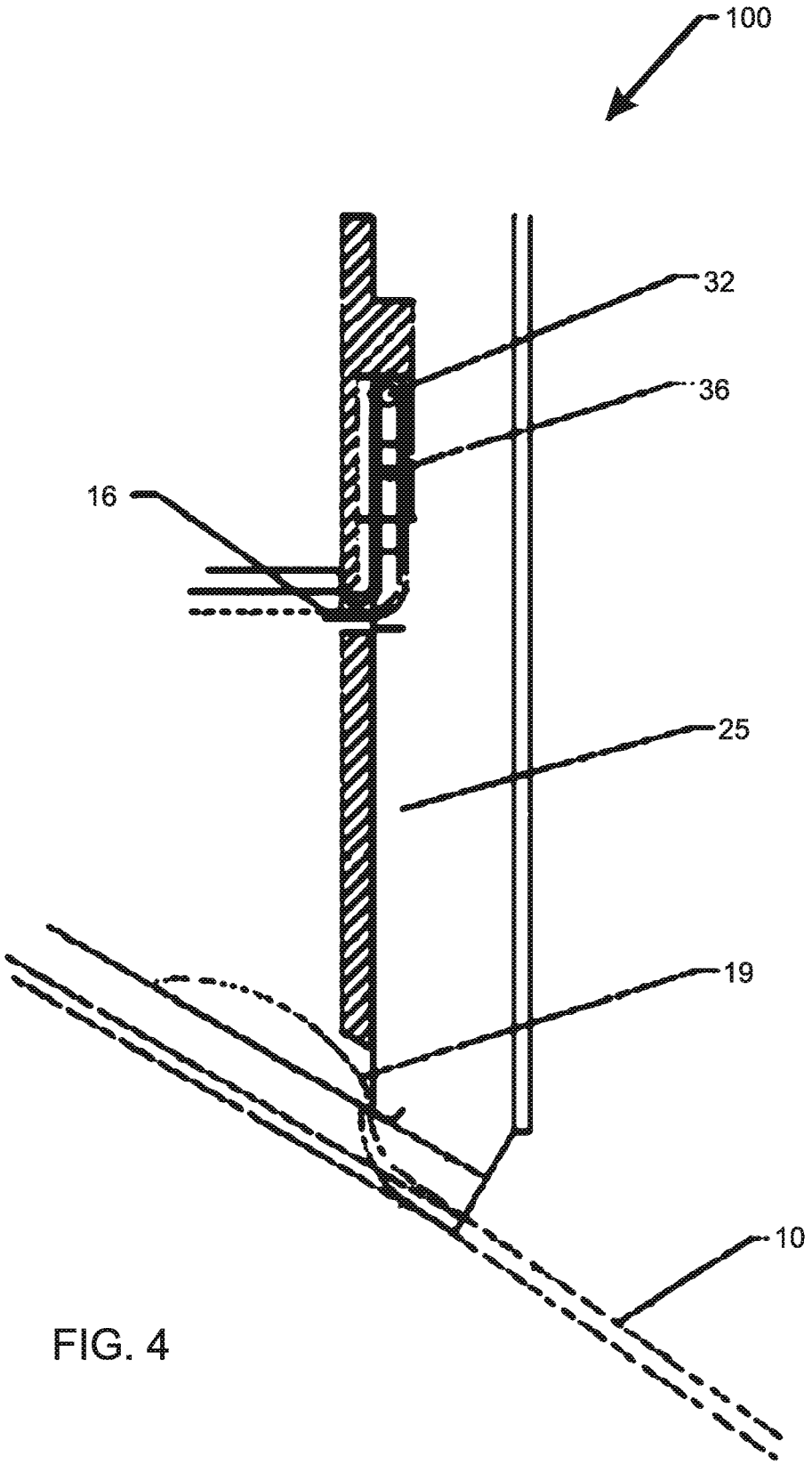
FIG. 4 is a detail at rest view of the no touch dispenser.
Figure 4A:
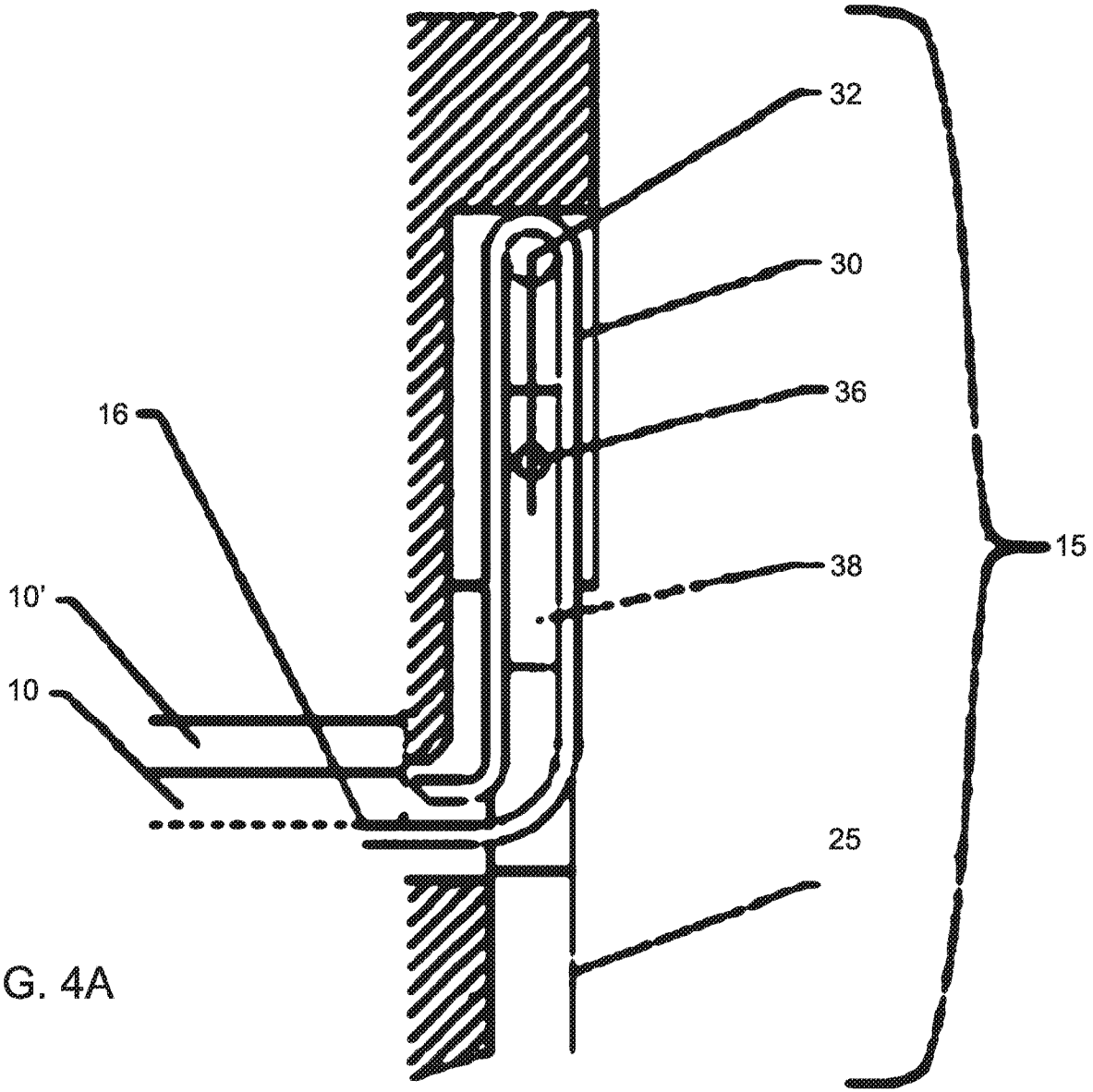
FIGS. 4A and 4B are expanded section views of the no touch dispenser escapement mechanism.
Figure 4B:
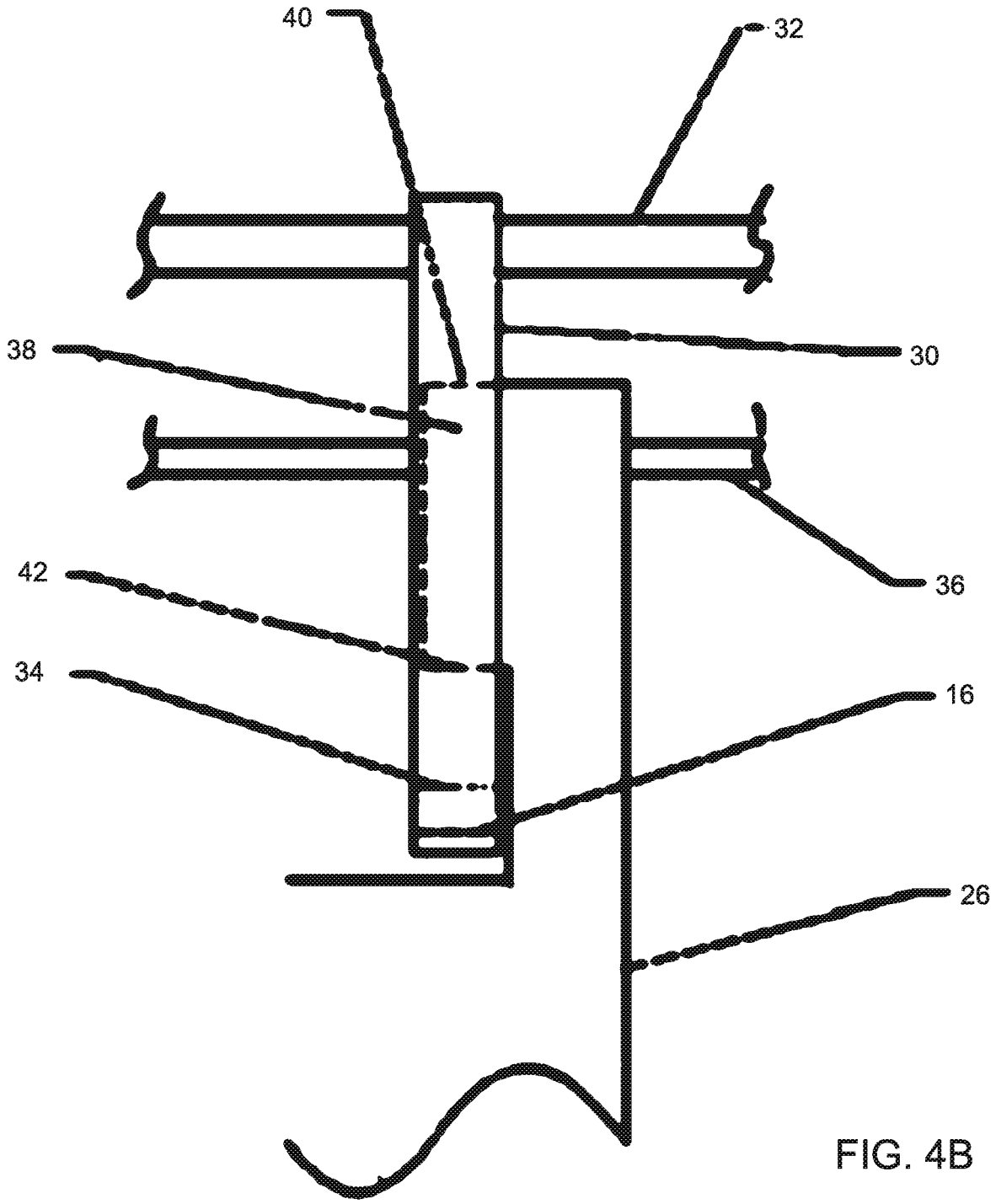
Figure 5:
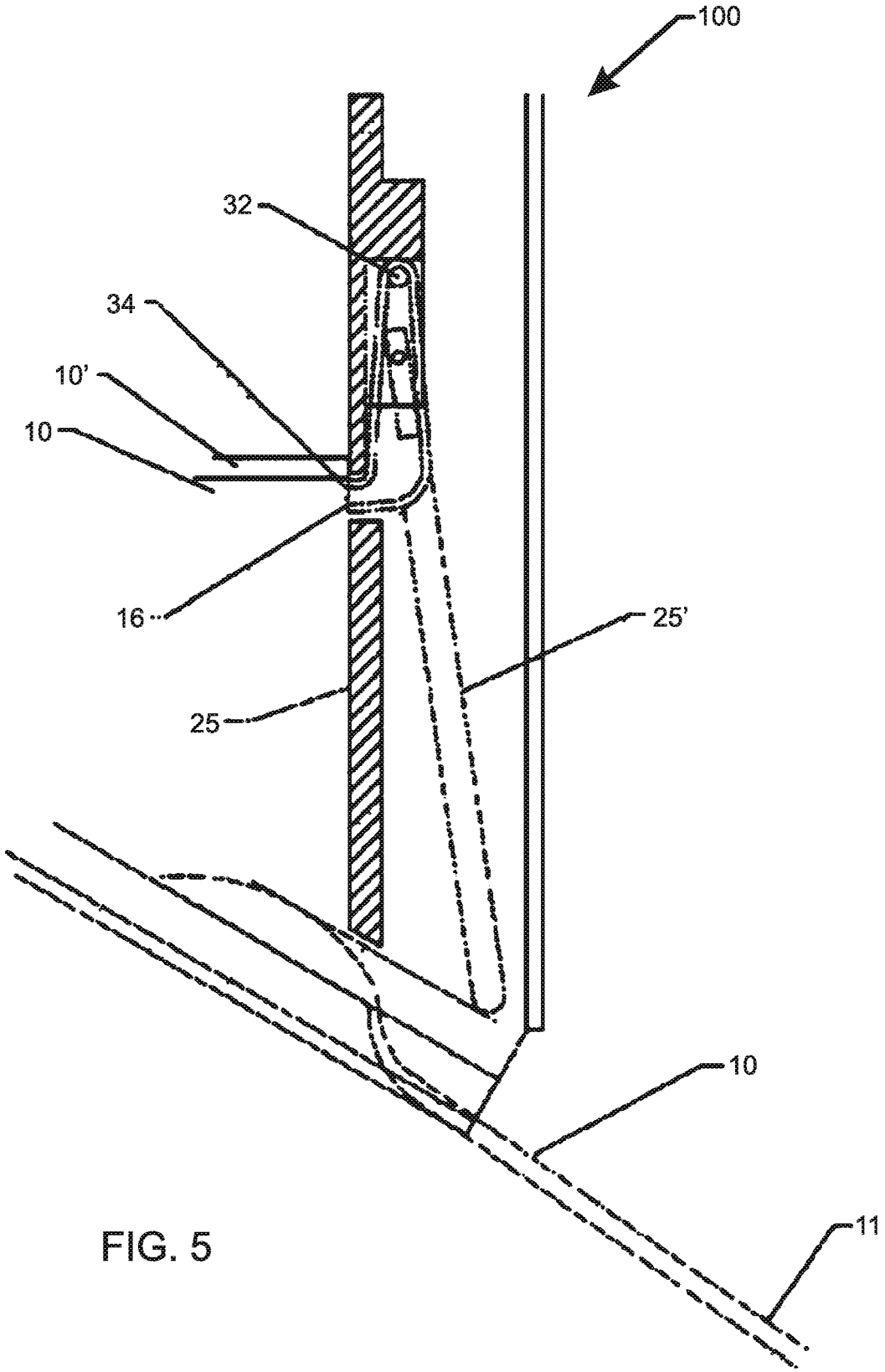
FIG. 5 is a detail section dispensing view of the no touch utensil dispenser.

Referring now to FIGS. 4, 4A, and 4B, there are shown detail views of escapement mechanism 15 in the rest position. The rest position is that at which the dispenser is at rest, between the actions of dispensing a utensil 10 and the cantilever action 17 that occurs during the automatic replenishment of the utensil 10. FIG. 4B is an end view that shows escapement actuator finger 26 in rest position 25. An escapement leaf spring 30 is mounted to an escapement spring axle 32 to allow the movement of escapement leaf spring 30 during the movement of escapement actuator finger 26 from rest position 25 to extended position 25' (FIG. 5). The escapement actuator finger 26 is held in place by an escapement actuator axle 36 that allows the pivoting motion between rest position 25 and extended position 25'. This motion, combined with an escapement actuator 38 being sandwiched between the two tines 16 and 34 of escapement leaf spring 30, creates an expansion of spring tines 16 and 34 that allow for the singular dispensing of a utensil 10 while retaining the next to last utensil 10'. The motion is best shown as the difference between FIGS. 4A and 5A.

Figure 5A:
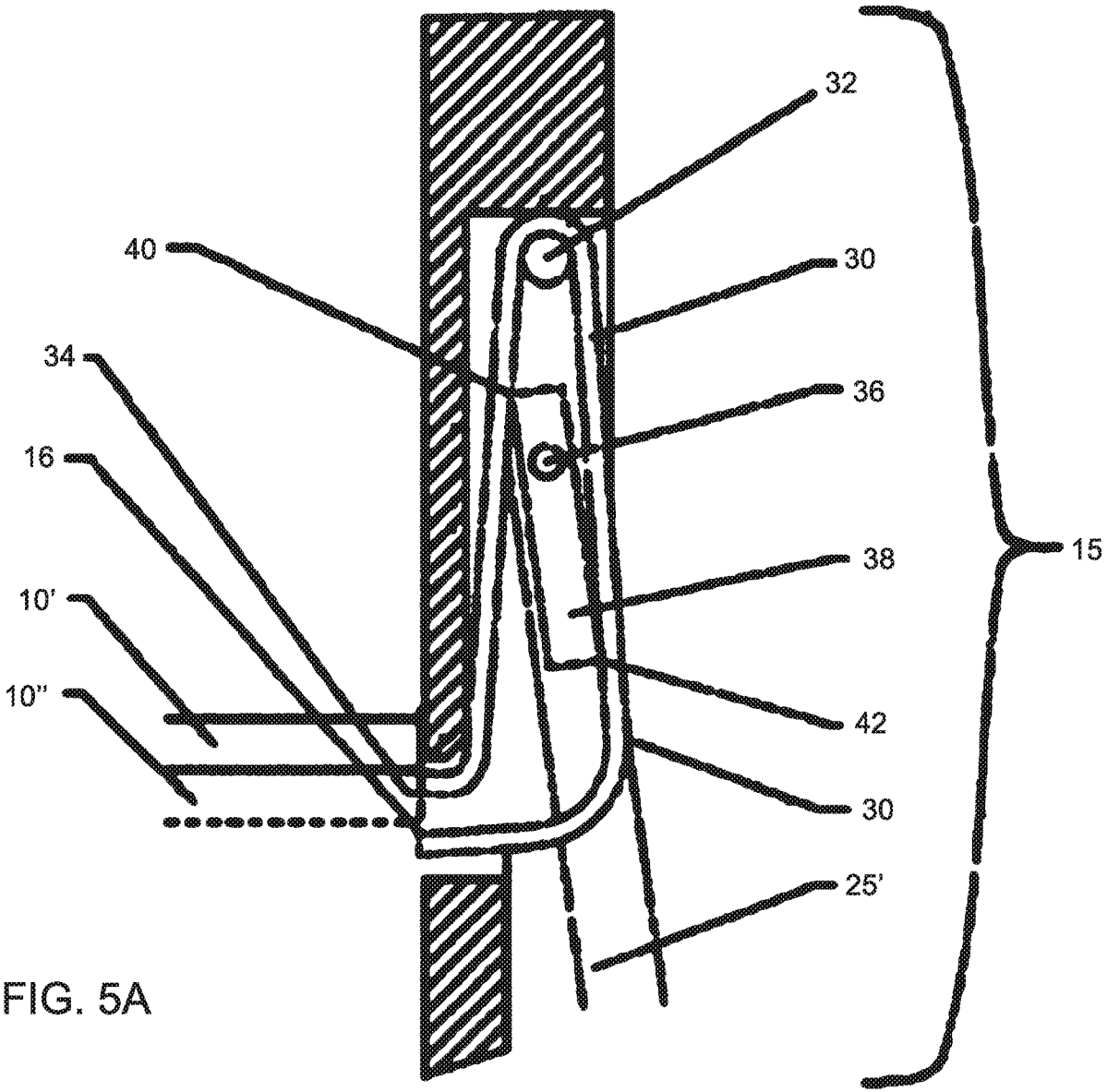
FIG. 5A is an expanded view of the no touch dispenser escapement mechanism.

Referring now to FIGS. 5 and 5A, there is shown a detailed view of escapement mechanism 15 in the extended position. The dispenser 100 is currently dispensing a utensil 10 by the cantilever action 17 that occurs during the automatic replenishment of the utensil 10. As mentioned hereinabove, FIG. 5A illustrates the point at which a utensil 10 has been deployed and a replenishment utensil has come to the fore. As escapement actuator 38 begins to rotate about its axle 36, the two escapement actuator corners 40 and 42 apply outward pressure on the two tines 16 and 34 of escapement leaf spring 30 to begin the process of singulation. Escapement spring hold protrusion 34 retains the inventory of stored utensils 10 inside dispenser 100 as each utensil 10 is dispensed.

The complete process for retrieving a utensil 10 and dispensing a replacement therefor is described below.

Figure 6:
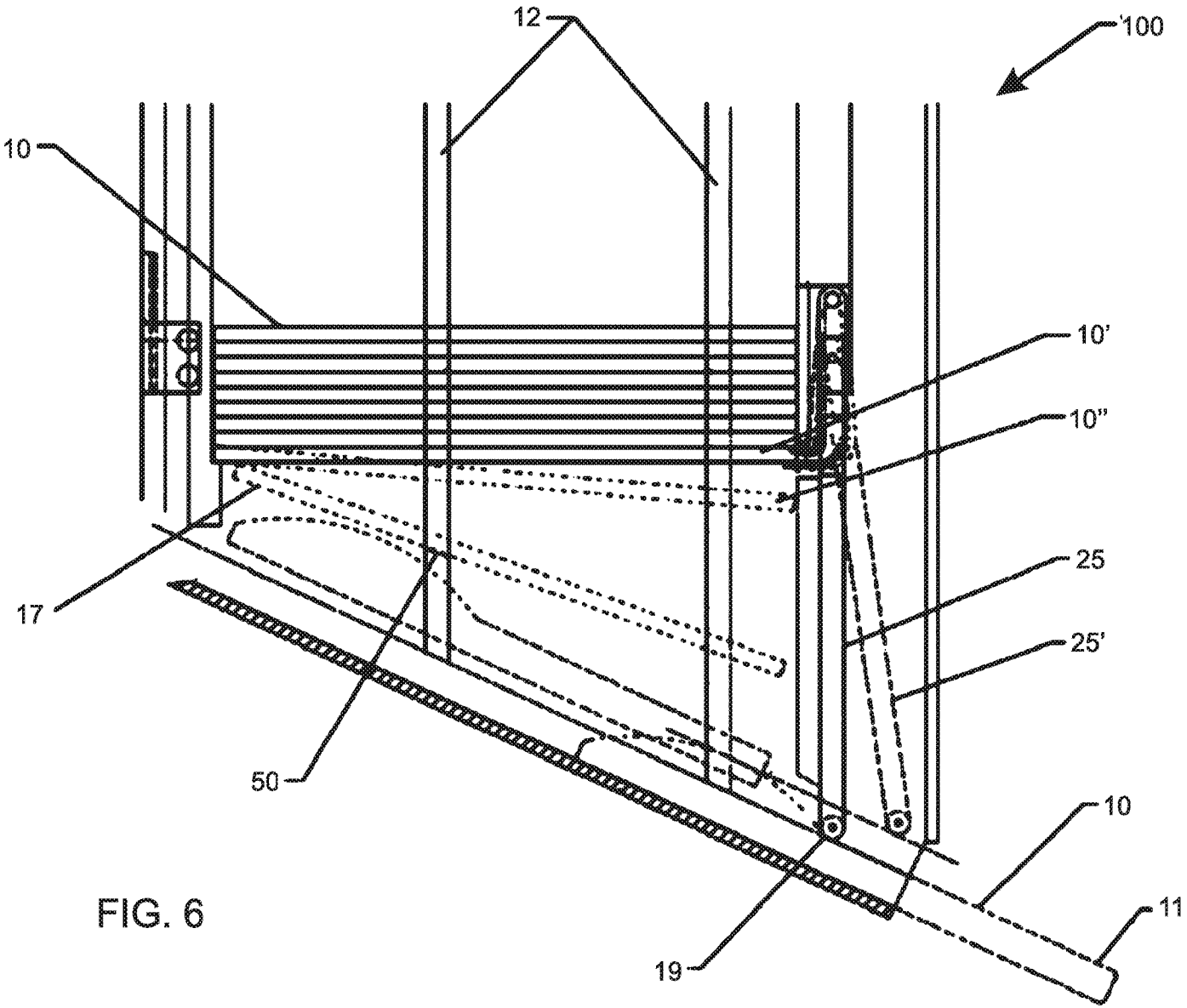
FIG. 6 is a detail view of a flat utensil dispenser.

Referring now to FIG. 6, there is shown a view of a dispenser 100 embodiment configured for dispensing flat utensils 10, such as knives. The process for dispensing described herein is substantially similar. For knives, the falling utensil 10 strikes a longitudinal ledge 50 during the cantilever action 17 to create a rotation that occurs during dispense. Such a rotation pivots the knife into a 90-degree longitudinal position to the exit area rest position 19 to keep the utensil 10 from prematurely exiting the dispenser 100.

Figure 7:
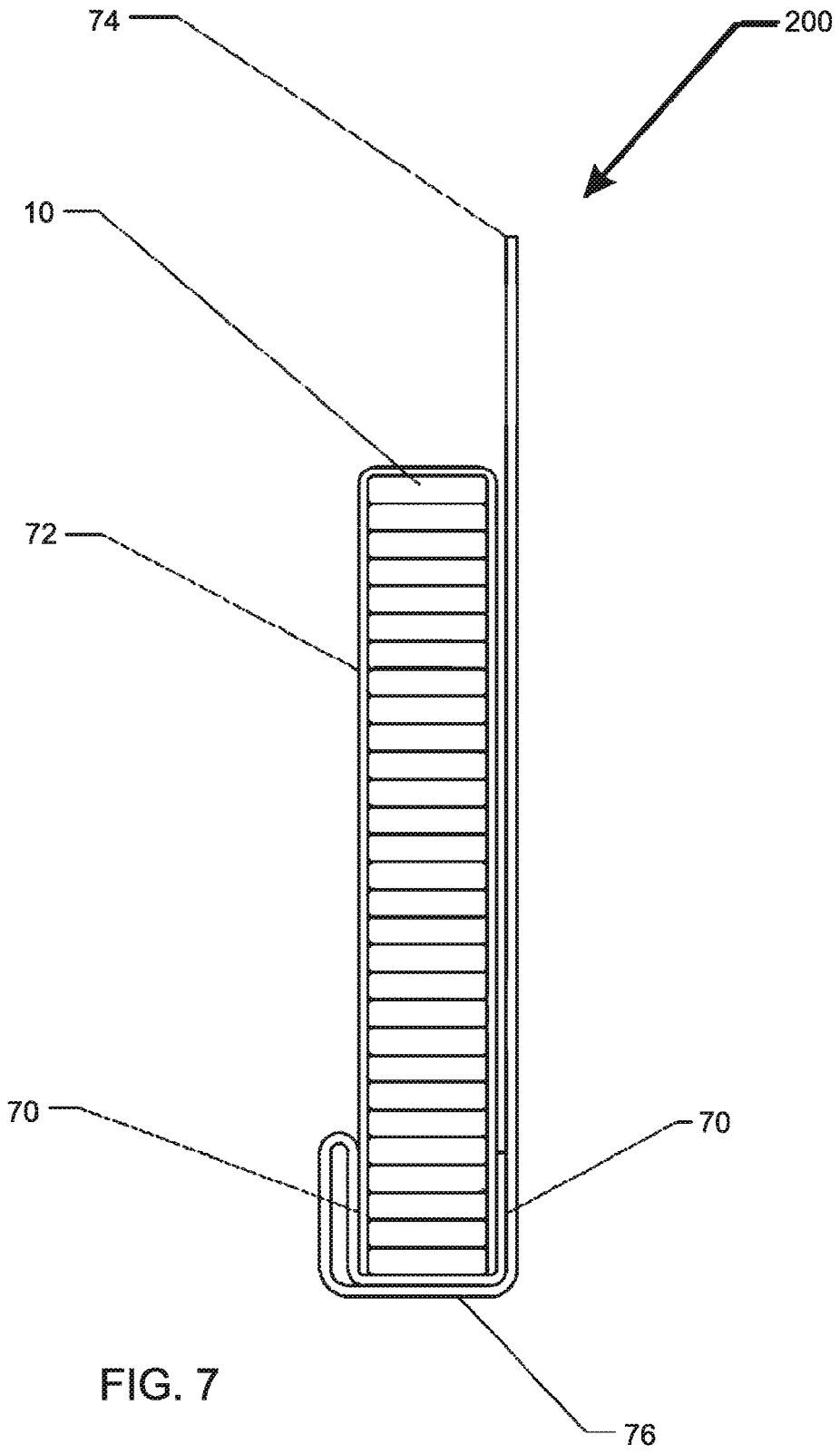
FIG. 7 is an end view of the no touch dispenser refill embodiment.

Referring now to FIG. 7, there is shown an end view of a bulk refill pack 200 of utensils 10. In this view, utensils 10 can be any utensil dispensable by dispenser 100. The bulk refill pack 200 consists of a stack of utensils 10 sheathed on three sides with a suitable material 72, such as cardboard. The bottom of the stack 76 is open except for a band of backing material 71 that retains the utensils in the bulk refill pack 200 by use of a limited, localized pressure sensitive adhesive 70 applied to backing material 71 to create a section of pressure sensitive tape 73 for concomitant containment and cleanliness used to retain the stack 76 in place. The method for deploying the bulk refill pack is described below.

The following is the sequence for dispensing a no touch spoon or fork utensil. The top 20 hinges open for filling the dispenser 100 with utensils 10. An operator loads the utensil bulk refill pack 200 while wearing rubber gloves, which is a normal item in the food industry. The utensils 10 are aligned by guides 12 along the Y-axis and the utensil container box 72 on the ends in the X-axis. The stack 76 of utensils 10 rests on two stops 14 and 16. Distal stop 14 is a ledge that is part of the back wall of dispenser 100 and the complementary side is the escapement release protrusion 16. Tab 74 of bulk refill pack 200 is pulled upwards on the utensil bulk refill pack 200. A pressure sensitive adhesive (PSA) tape 73 is peeled back on one side of the cardboard magazine container 72. After the tape 73 is peeled across the bottom of stack 76, the whole utensil stack 76 is released and the entire cardboard utensil container box 72 and tape 73 is removed vertically. A single utensil 10 is manually loaded into the exit area rest position 19. At this point, the dispenser 100 is ready for use.

The consumer then pulls on handle 11 of the utensil 10 in the exit area rest position 19. The escapement finger 26 rotates 25, 25' about a pivot pin 36. Two escapement finger corners 40, 42 push against the escapement leaf spring 30. The escapement spring hold protrusion 34 engages the bottom handle surface of the next to last utensil 10' to hold all but the last utensil in place. As the escapement finger corners 40, 42 continue to rotate, the escapement release protrusion 16 moves and releases only the bottom utensil handle 10". The bottom utensil handle 10" falls. The captured distal end 14 rotates, then releases 17 from the ledge 14. The handle 10" of the falling bottom utensil drops into a groove 27 in the bottom slide guide 29 and slides downward until the spoon or fork underside stops on escapement finger 26. Two flexible wires 24 act as guides for the handle if the consumer pulls the exiting utensil 10" too slowly.

The knife-only dispenser (FIG. 6) operates the same way as the spoon and fork dispenser (FIG. 2) but the knife goes through an extra motion to be ready for next dispense. Again, one knife 10 must be escaped or placed in the exit area rest position 19. The escapement leaf spring 30 both releases the lowermost knife and holds the magazine stack 76 above the lowermost knife 10'. The handle 10" starts to fall 17. As the constrained end of the knife is released from the ledge 14, the entire knife falls. A longitudinal ledge 50 on knife guide 12 restricts one side of the knife and the knife begins to pivot. The gaps of guide 12 are narrowed to keep the knife in a 90 degree longitudinal position as it falls. The lower edge of the knife drops into a groove in the bottom slide guide 29. The knife slides until it is stopped in the exit area rest position 19 by the escapement finger 26. The escapement finger 26 may have a roller on the bottom with teeth to match the knife serrations. Without the roller 31, the knife serrations may be deformed as knife 10 is pulled 11 out of the exit area rest position 19, making the knife a poor cutting utensil. The dispenser 100 is then ready to dispense the next knife.

The foregoing description of the embodiments of the invention has been presented for the purposes of illustration and description. Each and every page of this submission, and all contents thereon, however characterized, identified, or numbered, is considered a substantive part of this application for all purposes, irrespective of form or placement within the application. This specification is not intended to be exhaustive or to limit the invention to the precise form disclosed. Many modifications and variations are possible in light of this disclosure.

Although the present application is shown in a limited number of forms, the scope of the invention is not limited to just these forms, but is amenable to various changes and modifications without departing from the spirit thereof. The disclosure presented herein does not explicitly disclose all possible combinations of features that fall within the scope of the invention. The features disclosed herein for the various embodiments can generally be interchanged and combined into any combinations that are not self-contradictory without departing from the scope of the invention. In particular, the limitations presented in dependent claims below can be combined with their corresponding independent claims in any number and in any order without departing from the scope of this disclosure, unless the dependent claims are logically incompatible with each other.

We claim:

1. A dispenser device for dispensing utensils seriatim, comprising:

a housing configured for holding a plurality of cutlery articles, said housing comprising a rear wall and a front wall oppositely disposed thereto;

at least one alignment guide configured to maintain said plurality of cutlery articles in a stack within said housing, said plurality of cutlery articles being co-aligned in the stack to provide a plurality of handle ends proximate said front wall, and a plurality of distal ends proximate said rear wall;

a dispensing position proximate an exit area of said dispenser device, a handle portion of a first cutlery article being maintained at least partially accessible to a user when the first cutlery article is located in the dispensing position; and an actuator mechanism that is activated by said first cutlery article as said user grasps said handle portion of said first cutlery article in said dispensing position and removes said first cutlery article from said dispenser device, said actuator mechanism operating mechanically when activated to release a replacement cutlery article from said stack of said plurality of cutlery articles;

upon completion of said release, the replacement cutlery article being delivered to said dispensing position under the sole impulsion of gravity, said replacement cutlery article being thereafter removable by a next user upon grasping a handle portion thereof.

2. The dispenser device of claim 1, wherein the dispenser device is compatible for dispensing a fork.

3. The dispenser device of claim 1, wherein the dispenser device is compatible for dispensing a spoon.

4. The dispenser device of claim 1, wherein the dispenser device is compatible for dispensing a spork.

5. The dispenser device of claim 1, wherein the dispenser device is compatible for dispensing a knife.

6. The dispenser device of claim 5, wherein the dispenser device rotates said knife from a horizontal orientation to a vertical orientation as it is delivered to the dispensing position.

7. The dispenser device of claim 1, wherein said actuator mechanism is pivotably connected to said front wall.

8. The dispenser device of claim 1, further comprising a ledge extending inwardly from said rear wall and configured to support said stack of said plurality of cutlery articles.

9. The dispenser device of claim 1, further comprising a release protrusion configured to support said plurality of cutlery articles.

10. The dispenser device of claim 1, further comprising:

a release protrusion extending inwardly from an opening in said front wall and configured to support said stack of said plurality of cutlery articles, said release protrusion being retracted when said actuator mechanism is activated; and a hold protrusion disposed above said release protrusion, said hold protrusion being retracted when said release protrusion is extended;

said hold protrusion being extended inwardly from said opening in said front wall when said actuator mechanism is activated and said release protrusion is retracted;

said hold protrusion being configured, when extended inwardly from said opening in said front wall, to retain a remaining plurality of cutlery articles in said stack as said replacement cutlery article is released from said stack of said plurality of cutlery articles.

11. The dispenser device of claim 1, further comprising:

a ledge extending inwardly from said rear wall and configured to support said plurality of distal ends of said cutlery articles in said stack of said plurality of cutlery articles; said actuator mechanism comprising a release protrusion and a hold protrusion;

said release protrusion extending inwardly from said front wall and being configured to support said plurality of handle ends in said stack;

said release protrusion being mechanically retracted by said actuator mechanism when said actuator mechanism is activated;

said hold protrusion being mechanically extended inwardly when said actuator mechanism is activated so as to provide retention of a remaining plurality of cutlery articles in said stack of said plurality of cutlery articles.

12. The dispenser device of claim 1, wherein said first cutlery article when in said dispensing position is oriented along an incline with said handle portion of said first cutlery article being lower than a distal portion of said first cutlery article.

13. The dispenser device of claim 1, further comprising an inclined slide groove configured to guide the handle portion of said replacement cutlery article as it is delivered to the dispensing position.

14. The dispenser device of claim 1, wherein upon release of the replacement cutlery article, the actuator mechanism is configured to cause the replacement cutlery article to be delivered to the dispensing position by gravitational force.

15. A cutlery dispenser device comprising:

a housing configured for holding a plurality of cutlery articles, said housing comprising a rear wall and a front wall oppositely disposed thereto;

at least one alignment guide configured to maintain said plurality of cutlery articles in a stack within said housing, whereby said plurality of cutlery articles are co-aligned in the stack to provide a plurality of handle ends proximate said front wall, and a plurality of distal ends proximate said rear wall;

a dispensing position proximate an exit area of said dispenser device, a handle portion of said first cutlery article being maintained at least partially accessible to a user when said first cutlery article is in said dispensing position; and an actuator mechanism that is activated by the first cutlery article as said user grasps said handle portion of said first cutlery article in said dispensing position and removes said first cutlery article from said dispenser device, said actuator mechanism operating mechanically when activated to release a replacement cutlery article from said stack of said plurality of cutlery articles upon completion of said release, the replacement cutlery article being delivered to said dispensing position under the sole impulsion of gravity, said replacement cutlery article being thereafter removable by a next user upon grasping a handle portion thereof.

16. The cutlery dispenser device of claim 15, wherein the cutlery dispenser device is compatible for dispensing at least one of a fork, a spoon, a spork, and a knife.

17. The cutlery dispenser device of claim 15, wherein the cutlery dispenser device is configured to rotate the first cutlery article from a horizontal orientation to a vertical orientation as it is delivered to the dispensing position.

18. The cutlery dispenser device of claim 15, wherein said actuator mechanism is pivotably connected to said front wall.

19. The cutlery dispenser device of claim 15, further comprising a ledge extending inwardly from said rear wall and configured to support said stack of said plurality of cutlery articles.

20. The cutlery dispenser device of claim 15, further comprising a release protrusion configured to support said plurality of cutlery articles.

21. The cutlery dispenser device of claim 15, further comprising:

a release protrusion extending inwardly from an opening in said front wall and configured to support said stack of said plurality of cutlery articles, said release protrusion being retracted when said actuator mechanism is activated; and a hold protrusion disposed above said release protrusion, said hold protrusion being retracted when said release protrusion is extended;

said hold protrusion being extended inwardly from said opening in said front wall when said actuator mechanism is activated and said release protrusion is retracted;

said hold protrusion being configured, when extended inwardly from said opening in said front wall, to retain a remaining plurality of cutlery articles in said stack as said replacement cutlery article is released from said stack of said plurality of cutlery articles.

22. The cutlery dispenser device of claim 15, further comprising:

a ledge extending inwardly from said rear wall and configured to support said plurality of distal ends of said cutlery articles in said stack of said plurality of cutlery articles, said actuator mechanism comprising a release protrusion and a hold protrusion;

said release protrusion extending inwardly from said front wall and being configured to support said plurality of handle ends in said stack;

said release protrusion being mechanically retracted by said actuator mechanism when said actuator mechanism is activated;

said hold protrusion being mechanically extended inwardly when said actuator mechanism is activated so as to provide retention of a remaining plurality of cutlery articles in said stack of said plurality of cutlery articles.

23. The cutlery dispenser device of claim 15, wherein said dispensing position is configured to maintain said first cutlery article, when in said dispensing position, oriented along an incline with said handle portion of said first cutlery article being lower than a distal portion of said first cutlery article.

24. The cutlery dispenser device of claim 15, further comprising an inclined slide groove configured to guide the handle portion of said replacement cutlery article as it is delivered to the dispensing position.

25. The cutlery dispenser device of claim 15, wherein upon release of the replacement cutlery article, the actuator mechanism is configured to cause the replacement cutlery article to be delivered to the dispensing position by gravitational force.

* * * * *